US005238049A

United States Patent [19]

Martin

[11] Patent Number: 5,238,049

[45] Date of Patent: Aug. 24, 1993

[54] ADJUSTABLE FLOW CONTROL DEVICE FOR CONTINUOUS CASTING OF METAL STRIP

[75] Inventor: James P. Martin, Powhatan, Va.

[73] Assignee: Reynolds Metals Company, Richmond, Va.

[21] Appl. No.: 957,330

[22] Filed: Oct. 6, 1992

[51] Int. Cl.[5] ..... B22D 11/06; B22D 11/18

[52] U.S. Cl. ..... 164/479; 164/488; 164/429; 164/437; 222/594

[58] Field of Search ..... 164/423, 463, 479, 429, 164/437, 488, 489; 222/594; 266/229, 230

[56] References Cited

U.S. PATENT DOCUMENTS 3,799,410 3/1974 Blossey et al. .
3,831,659 8/1974 Gerding et al. .
4,550,767 11/1985 Yu et al. .
4,591,135 5/1986 Fosnacht et al. .
4,828,012 5/1989 Honeycutt, III et al. .
4,865,115 9/1989 Hirata et al. .
4,896,715 1/1990 Honeycutt .
4,934,443 6/1990 Honeycutt, III et al. .
4,940,077 7/1990 Honeycutt, III et al. .
4,945,974 8/1990 Honeycutt, III .
4,955,429 9/1990 Honeycutt, III et al. .

*Primary Examiner*—Mark Rosenbaum
*Assistant Examiner*—Erik R. Puknys
*Attorney, Agent, or Firm*—Robert C. Lyne, Jr.

[57] ABSTRACT

An adjustable flow control device for use in a metal strip continuous casting apparatus comprises a tundish for directing molten metal onto a moving chill surface and a plurality of individually and vertically adjustable flow control plates which extend across the width of the tundish. Each of the individual and vertically adjustable flow control plates define a flow passageway between the plate bottom edge and the tundish floor for controlling molten metal flow in the tundish. By providing individually adjustable flow control plates, flow of molten metal can be controlled in discrete width portions of the tundish to improve cast strip thickness and cross-sectional profile. The adjustable flow control device may be responsive to sensed casting parameters to permit automatic and precise control over cast strip thickness and cross-sectional profile during continuous casting of metal, in particular, aluminum alloys.

17 Claims, 5 Drawing Sheets

ADJUSTABLE FLOW CONTROL DEVICE FOR CONTINUOUS CASTING OF METAL STRIP

FIELD OF THE INVENTION

This invention relates to a flow control device for continuous casting of metal strip by delivering molten metal from a tundish onto a driven chill surface. The flow control device permits control of temperature and flow patterns prior to molten metal contact with the driven chill surface to provide improved control over cast strip profile and gauge.

BACKGROUND ART

In the prior art, it is known to produce aluminum in coil form from a continuous casting apparatus wherein molten aluminum is delivered from a tundish and cast in the form of a metal sheet or strip and rolled into a coil on a coiler. Generally, in this process, molten aluminum is deposited on a moving chill surface from a tundish having an open outlet. An inlet is provided for the flow of molten metal into the tundish from a source of molten metal. The direct casting of the molten aluminum metal onto a chill wheel, preferably a grooved chill wheel, produces a cast aluminum product at a rapid rate. The aluminum cast strip is wound on a coiler in heated form, generally at a temperature in the range of about 900° F.

Drag casting apparatus and methods of this types are described, for example, in U.S. Pat. Nos. 4,828,012, 4,896,715, 4,934,443, 4,945,974, 4,940,077 and 4,955,429. The disclosures of these patents are hereby specifically incorporated by reference with respect to the method and apparatus for the production of aluminum strip and coil from molten aluminum or aluminum alloys.

In order to properly coil the as-cast strip or further work the cast strip into a product having satisfactory quality, it is important to provide a cast strip leaving the casting surface having a proper shape or cross-sectional profile.

Difficulties have been encountered in prior art processes in achieving acceptable cast strip cross-sectional profiles in drag casting of aluminum products. Delivering molten aluminum from a tundish onto a moving chill surface produces a sheet product having an increased thickness at the edges thereof. This increased thickness is a result of a faster cooling rate at the edges of the chill surface and a corresponding "dog-bone" effect, or washboard or wavy edge. This condition prevents effective coiling of the cast strip as well as difficulties in further reducing the cast strip in subsequent rolling operations. Cold rolling of sheet or strip product generally requires that the sheet or strip have a slightly thicker center portion than edge portion. Strip having a "dog bone" shape generally has thick edge portions and a thinner crown section.

In the prior art, various devices have been proposed in conjunction with direct casting apparatus for improved continuous cast strip profile and gauge. In U.S. Pat. No. 4,828,012 to Honeycutt, III et al., diffusion means are provided in a tundish structure to produce a substantially uniform flow rate through the tundish and across its width as molten metal approaches a chill surface. The tundish also includes a flow control gate mounted for vertical sliding movement between sidewalls of the tundish. The gate is adapted to be moved from a lowered position which prevents flow of metal to the exit lip of the tundish to a raised position out of contact with the molten metal to permit free flow to the chill casting surface.

U.S. Pat. No. 4,940,077 to Honeycutt, III et al. is drawn to a direct metal strip casting apparatus wherein the width of the strip being cast may be changed without interrupting the casting operation. This patent also discloses adjustable or moving baffles to compensate for any flow pattern change resulting from the insertion or removal of the width changing device.

U.S. Pat. No. 4,955,429 discloses another direct casting apparatus. In this patent, the tundish is provided with flow distribution diffusers to control and diffuse the flow of molten metal to provide substantially uniform temperature across the width of the tundish at the outlet. This patent indicates that, in casting aluminum strip having a nominal thickness of about 0.040 inches, a temperature variation of 10° F. in the tundish will result in a strip thickness change of approximately 0.001 inch.

Devices have also been proposed for control of molten metal flow in tundishes associated with dual-roll continuous casting machines. Each of U.S. Pat. Nos. 3,799,410 to Blossey et al. and 4,550,767 to Murrysville et al. disclose fixed baffle means to facilitate control of the flow of molten metal in a tundish prior to continuous casting. In U.S. Pat. No. 4,865,115 to Hirata et al., a twin roll continuous casting apparatus is disclosed having opposing core sections forming a slit nozzle. One core section is held stationary with the other core section being supported as to move toward or away from the stationary core section to adjust the distance between the core sections. The movable core section permits adjusting the width of the slit nozzle and consequently controlling the flow rate of melt through the nozzle.

U.S. Pat. No. 4,591,135 to Fosnacht et al. discloses another tundish for continuous casting of molten metal having a dam which provides uniform residence times in the tundish prior to molten metal exiting the tundish. A fluid flow control structure is located between the dam and the tundish sidewalls to avoid a dead zone area in the tundish.

Disadvantages of prior art devices associated with tundishes and control of molten metal flow in continuous casting processes include inability to maintain precise control across the width of the cast strip. As such, a need has developed to more effectively control the flow of molten metal in the tundish prior to the molten metal contacting the casting surface for improved strip profile and gauge control.

In response to this need, the present invention provides an adjustable flow control device which permits precise control over the molten metal flow patterns in a tundish. Capability of maintaining a desired gauge consistency and thickness profile is provided by control of the adjustable flow control device in response to sensed casting variables during the continuous casting operation.

None of the above-listed documents teach or fairly suggest an adjustable flow control device for continuous casting of metal strip that comprises a plurality of adjustable baffles that extend across the width of a tundish.

SUMMARY OF THE INVENTION

It is accordingly one object of the present invention to provide an adjustable flow control device for continuous casting of metal strip which provides improved continuous cast strip cast quality.

It is another object of the present invention to provide an adjustable flow control device for continuous casting which provides precise control of molten metal flow across the entire width of a tundish during continuous casting.

It is a further object of the present invention to provide an adjustable flow control device for continuous casting of metal strip which permits control of cast strip gauge and profile through feedback control of the adjustable flow control device based on sensed casting parameters.

Other objects and advantages of the present invention will become apparent as the description thereof proceeds.

In satisfaction of the foregoing objects and advantages, there is provided by the present invention an adjustable flow control device for use in a metal strip continuous casting apparatus comprising a tundish for directing molten metal onto a moving chill surface and a plurality of vertically adjustable flow control plates extending across the width of the tundish. Each of the vertically adjustable flow control plates define a flow passageway between the bottom of each plate and the floor of the tundish. By individually adjusting each flow control plate, the flow pattern of molten metal across the width of the tundish may be controlled to achieve desired cast strip thickness and cross-sectional profile.

The vertically adjustable flow control plates may be adjusted based on sensed casting parameters such as molten metal temperature, cast strip gauge or the like to provide automatic control during a particular casting operation. Vertical adjustment of the flow control plates may include pneumatic, hydraulic or other known means for actuating the flow control plates.

The present invention also provides a method for controlling the thickness and cross-sectional profile of a direct cast strip product by sensing casting parameters such as cast strip thickness and adjusting the flow control device across the width of a tundish to control flow and temperature of molten metal in specific areas of the tundish and cast strip thickness and profile.

BRIEF DESCRIPTION OF DRAWINGS

Reference is now made to the Drawings accompanying the invention wherein.

DESCRIPTION OF THE PREFERRED EMBODIMENT

Figure 1:
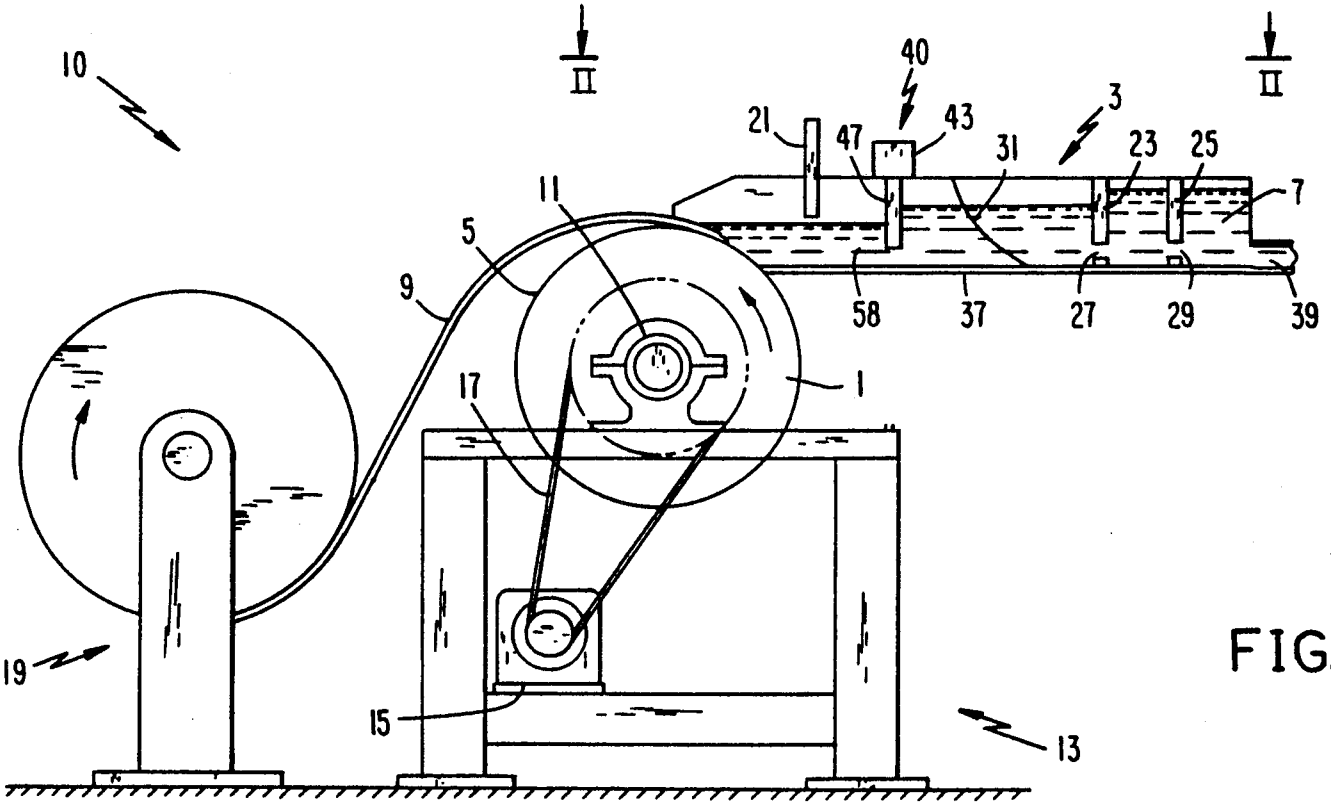
FIG. 1 shows a schematic view diagram of a direct casting apparatus with the sidewall of the tundish broken away to show greater detail.

The present invention is concerned with an apparatus and method for the continuous casting of metal strip, preferably aluminum alloys which have been drag cast using a tundish which delivers a molten metal to a moving chill surface to produce a cast strip product. The present invention provides improved control over cast strip thickness and cross-sectional profile by providing an adjustable flow control device which permits control of molten metal flow in discrete width portions across the entire width of a tundish.

The present invention provides an adjustable flow control device which includes a plurality of individual and vertically adjustable flow control plates across the width of a tundish. By individually and vertically adjusting each flow control plate, eddies or back-flow in selected areas of the molten metal in the tundish may be created. Creation of these eddies reduces the flow rate in the selected areas with a corresponding increase in dwell time of molten metal in the tundish. As the dwell time increases, more heat is lost in the areas of reduced flow which results in a decrease in the molten metal temperature as opposed to areas having a more direct or higher flow rate. By this indirect control of molten metal temperature in the tundish as a result of the creation of the eddies, gauge and/or cross-sectional profile of the cast metal strip can be controlled. For example, cooling the molten metal 10° F. in a particular tundish area can result in a gauge increase of approximately 0.001 inches in a corresponding strip area.

By individual control of the flow control plates across the width of a tundish, flow rates can be reduced in selected areas causing a reduction in molten metal temperature and increase in strip gauge. If a cast strip gauge needs to be increased in a certain portion of the width of the strip, the individual flow control plates can be adjusted to produce an increase in gauge in that particular area. On the other hand, if the cast strip gauge is too thick, the individual flow control plates can be adjusted to increase flow such that the temperature of molten metal in the tundish does not decrease, thereby achieving a reduction in gauge thickness. Moreover, a plurality of the individual flow control plates may be adjusted to provide control over the cast strip profile. For example, if the cast strip is under gauge in a central portion thereof, the individual flow control plates may be adjusted to achieve a more uniform cross-sectional profile across the entire width of the strip.

As noted above, the present invention is primarily concerned with the production of aluminum or aluminum alloy strip which has been cast from a direct casting process. The direct casting of metal strip is known in the prior art as shown, for example in U.S. Pat. No. 4,945,970 and the other prior art documents mentioned above. In general, and with reference to FIG. 1, an apparatus for the direct casting of aluminum alloys is generally designated by the reference numeral 10 and is seen to include a casting wheel 1 which is internally cooled with a circulating water or other cooling fluid adjacent to a tundish assembly 3. The casting wheel 1 includes a casting surface 5 which rapidly extracts heat from the molten metal 7 delivered from the tundish assembly 3 to the surface 5 of the casting wheel 1. Preferably, the chill surface of the casting wheel includes grooves therein. The molten metal 7 is withdrawn as a strip 9 from the casting apparatus and coiled in a conventional manner on a coiler 19.

Suitable means such as journal bearings 11 support the casting wheel 1 for rotation about a fixed horizontal axis on a rigid support frame 13. The casting wheel is driven by a suitable drive means such as a variable speed motor and reduction gear mechanism 15 and a drive chain or belt 17.

Although not shown, a rotary brush may be mounted in close proximity to the casting wheel 1 to maintain a uniform, polished, dense natural oxide coating on the chill surface 5.

Figure 2:
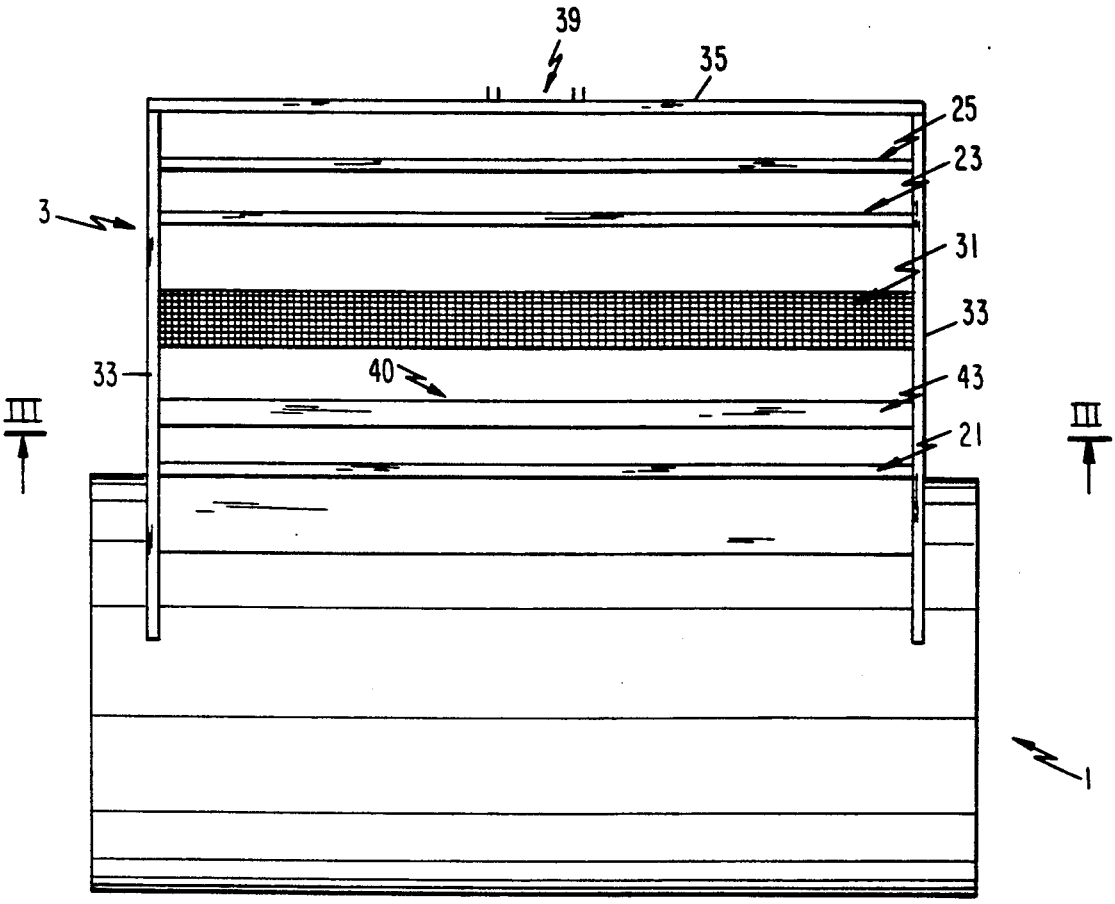
FIG. 2 shows a top view of the tundish and casting wheel depicted in FIG. 1.

With reference now to FIGS. 1 and 2, the tundish 3 includes a start-up gate 21 which extends across the entire width of the tundish and is vertically adjustable. The start-up gate is in a lowered position prior to the start-up of the casting operation and is raised to permit the molten metal 7 to flow towards the casting wheel. When raised, the start-up gate 21 may remain in contact with molten metal or above the moten metal surface during casting.

The tundish 3 also includes metal distribution boards 23 and 25 which include a plurality of openings 27 and 29, respectively therein. The metal distribution boards facilitate distribution of the molten metal during flow through the tundish 3.

The tundish also includes a diffusion screen 31 positioned across the width thereof to further facilitate metal distribution during a casting operation.

The tundish assembly 3 includes a pair of sidewalls 33, a back wall 35 and a floor 37. The back wall 35 includes an opening 39 which is designed to receive molten metal from a ladle or other source (not shown).

Positioned between the start-up gate 21 and the diffuser screen 31 is the adjustable flow control device which is generally designated by the reference numeral 40. The adjustable flow control device includes a plurality of flow control plates 41 and a housing structure 43 which houses the actuators that control vertical adjustment of each of the plates 41.

Figure 3A:
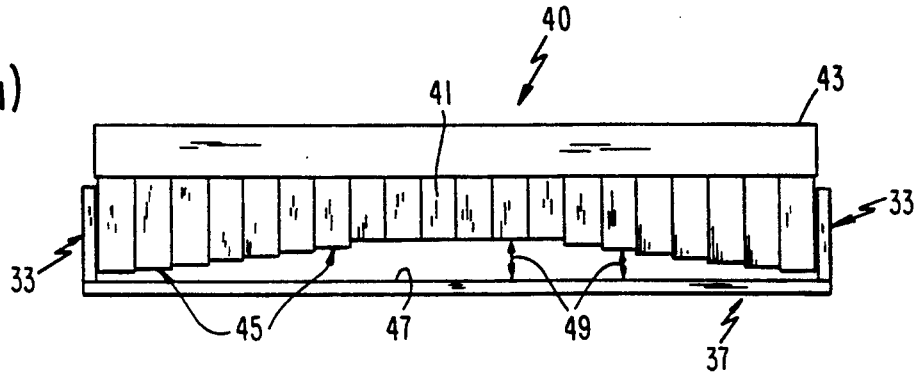
FIGS. 3*a*–3*c* show a view taken along the line III—III in FIG. 2 showing different configurations of the inventive flow control device.
Figure 3B:
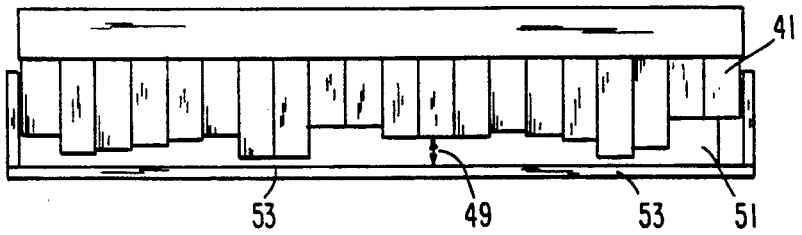
Figure 3C:
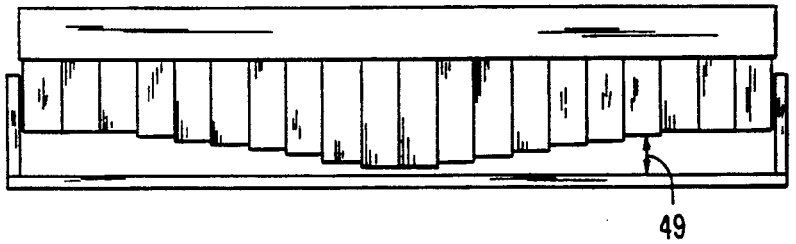

With reference now to FIGS. 3*a*–3*c*, different configurations of the adjustable flow control device are depicted. By vertical adjustment of each flow control plate 41, the bottom face 45 and the surface 47 of the floor 37 form gaps 49. In the configuration depicted in FIG. 3*a*, the center portion of the tundish is provided with the largest gap with the edge portions having the smallest gap.

With reference now to FIG. 3*b*, an unlimited number of configurations of the adjustable flow control device 40 may be obtained. As can be seen in FIG. 3*b*, the flow control plates 41 on the side edge 51 of the tundish 3 provide increased metal flow with the areas designated by the reference numeral 53 providing a decreased metal flow. By decreasing the molten metal flow in the areas 53, back eddies may be formed in the tundish in the area between the adjustable flow control device 40 and the start-up gate 21. With reference back to FIG. 1, this area is generally designated by the reference numeral 58. Since the flow of molten metal is reduced in these areas, the molten metal will be cooler than adjacent areas of molten metal resulting in an increase in gauge on the corresponding portion of the cast strip product.

FIG. 3*c* shows yet another configuration of the adjustable flow control device wherein the flow control plates 41 are lowered in the center portion of the tundish and raised on the edge portions thereof. This type of a configuration would result in an increase in gauge in the center portion of the strip with a reduction in gauge on the edges thereof.

Figure 4A:
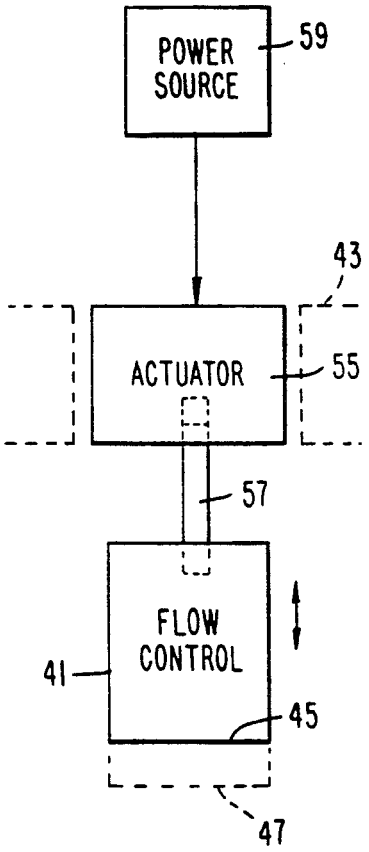
FIGS. 4*a* and 4*b* show a single adjustable flow control plate depicting means for controlling vertical adjustment thereof.

With reference now to FIG. 4*a*, a single vertically adjustable flow control plate is shown to illustrate one embodiment of the vertical adjustable aspect thereof. The flow control plate 41 may be connected to an actuator 55 via a connector 57. A power source 59 is operatively connected to the actuator 55. The actuator 55 is designed to vertically extend or retract the connector 57 to vertically adjust the flow control plate 41 and establish a predetermined distance between the lower edge 45 thereof and the tundish floor surface 47. The actuator 55 may be any known type of actuator in the art. For example, the actuator may be a pneumatic type wherein the power source 59 would be a source of compressor air or the like to drive the flow control plate 41. Alternatively, the actuator may be driven hydraulically or electrically with the power source 59 being a source of hydraulic pressure or electrical power, respectively. It should also be understood that the power source 59 would be controlled by the control means as will be described hereinafter.

Figure 4B:
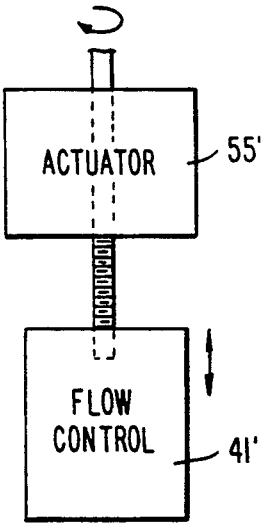

In another embodiment, FIG. 4*b* illustrates a manually adjustable flow control plate 41'. In this embodiment, the actuator 55' would comprise a screw which is threadably attached to the flow control plate 41' and is designed to lower or raise the flow control plate 41' by rotation of the screw in the actuator 55'. It should be understood that any known means for vertically adjusting the flow control plates may be utilized in the present invention. The embodiments disclosed in FIGS. 4*a* and 4*b* are merely exemplary and other types of devices may be used to vertically adjust the flow control plates 41 and 41'.

Figure 5:
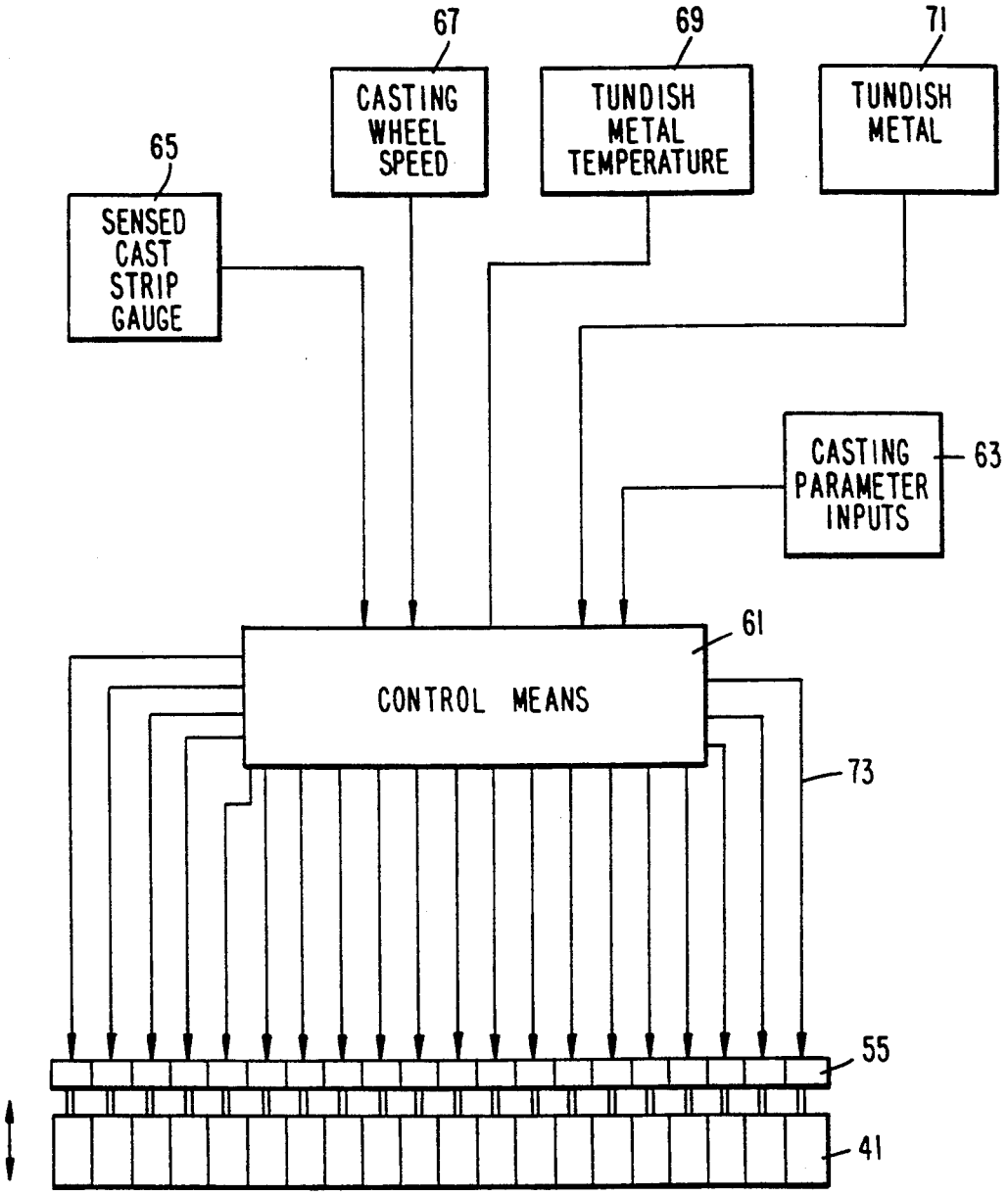
FIG. 5 shows a schematic diagram of an exemplary control sequence utilizing the adjustable flow control device of the present invention.

Although the flow control plates 41, may be individually adjustable in a manual fashion as illustrated in FIG. 4*b*, a preferred embodiment of the present invention would include automatic control of the vertical adjustment of each individual flow control plate. With reference now to FIG. 5, an exemplary control scheme is illustrated to permit automatic control over the casting process and the adjustable flow control device. The automatic control scheme includes a control means 61 which may be any known type such as a computer control means. The control means 61 has the capability to receive casting parameter inputs designated by the reference numeral 63. This inputted data may be used during initial start-up sequencing of the casting operation to set each of the flow control plates at a predetermined height prior to casting. The control means 61 is also designed to receive signals from various sensors associated with the casting process.

FIG. 5 shows four exemplary casting parameters, cast strip gauge designated by the reference numeral 65, casting wheel speed 67, tundish metal temperature 69 and tundish metal depth 71. Each of the sensed parameters are inputted to the control means 61.

In response to the sensed conditions 65, 67, 69 and 71, the control means 61 has the capability to send a signal 73 to each of the actuators 55 for operation of each flow control plate 41. Although not shown, the actuators 55 in FIG. 5 also include the necessary power source to drive the plates 41. Accordingly, each flow control plate 41 may be individually adjusted to form a predetermined flow passageway between the bottom of each flow control plate 41 and the tundish floor. By this individual control, an unlimited number of configurations can be obtained across the width of the tundish, and as illustrated in FIGS. 3*a*–3*c*.

With reference again to FIGS. 1 and 2, it should be understood that the housing 43 not only houses the individual actuators 55 for the flow control plates 41 but also provides support for the flow plates and actuators across the width of the tundish. The housing 43 may be supported by a structure separate from the tundish itself or, alternatively, be attached to the tundish or tundish support structure.

It should also be understood that although twenty flow control plates are illustrated in FIGS. 3a–3c and 5, any number of separate flow control plates may be utilized. For example, a more narrow tundish may require a fewer number of plates with a larger tundish requiring a greater number of plates.

The control means 61 permits automatic control of the cast strip gauge and/or cross-sectional profile. For example, if the cast strip gauge has an insufficient thickness at a particular portion of the cast strip width, the control means 61 can vertically adjust the flow control plates 41 at a particular width portion of the tundish to cool the molten metal in that area and produce an increase in gauge. In another example, if the cast strip is exhibiting increased thickness on the edges thereof, the flow control plates may be adjusted in the configuration illustrated in FIG. 3c to increase the gauge in the center portion of the cast strip and reduce the gauge on the edges thereof to produce an acceptable cross-sectional profile of the cast strip.

Although the adjustable flow control device is shown between the start-up gate 21 and the flow diffuser screen 31, the adjustable flow control device may be arranged in different locations in the tundish. For example, the adjustable flow control device may be positioned between the tundish lip adjacent the casting wheel and the start-up gate or as a replacement for one or both of the metal distribution boards 27 and 29.

The arrangement of the adjustable flow control device in the tundish will also effect the degree of temperature control and creation of eddies in the tundish. For example, if the flow control device is arranged near the tundish lip, the gap between the flow plates and the tundish floor will generally be smaller to provide the necessary temperature differentials in the molten metal within the tundish. Alternatively, if the adjustable flow control device replaces one or both of the metal distribution boards, less of a gap would be required to achieve the same temperature differentials in the molten metal.

As such, an invention has been disclosed in terms of preferred embodiments thereof which fulfill each and every one of the objects of the present invention as set forth hereinabove and provides a new and improved adjustable flow control device for continuous casting of metal which provides improved control over cast strip thickness and cross-sectional profile.

Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. An adjustable flow control device for use in a metal strip continuous casting apparatus comprising:

a) a tundish for directing molten metal onto a moving chill surface, and b) a plurality of means for controlling flow of molten metal across a width portion of said tundish, said plurality of means for controlling flow being adapted to control flow across the entire width of said tundish to impart a desired cross-sectional profile to said molten metal withdrawn from said tundish wherein each said plurality of means for controlling flow of a metal across said width portion of said tundish further comprises a plate and means for vertically adjusting each said plate to define a flow passageway between a bottom edge of said plate and floor of said tundish.

2. The adjustable flow control device of claim 1 wherein said means for vertically adjusting each said plate further comprises a support member extending across said tundish and an actuator means mountable on said support member, each said actuator means for raising or lowering a said plate.

3. The adjustable flow control device of claim 2 wherein each said actuator means is manually adjustable.

4. The adjustable flow control device of claim 2 wherein each said actuator means is pneumatically adjustable.

5. The adjustable flow control device of claim 2 wherein each said actuator means is electrically or hydraulically adjustable.

6. The adjustable flow control device of claim 1 further comprising means for sensing a casting parameter and for controlling each of said means for controlling flow of molten metal across a width portion of said tundish responsive to a sensed casting parameter.

7. The adjustable flow control device of claim 6 wherein said means for sensing a casting parameter further comprises means for sensing a parameter selected from the group consisting of cast strip thickness, cast strip profile, molten metal temperature, molten metal depth in said tundish and casting speed.

8. In a melt drag metal strip casting apparatus wherein molten metal is delivered from a tundish onto a moving chill surface and a continuous strip of metal is withdrawn from said moving chill surface having a cross-sectional profile, the improvement comprising:

an adjustable flow control device for use with said tundish, said adjustable flow control device further comprising a plurality of means for controlling flow of molten metal across a width portion of said tundish, said plurality of means for controlling flow being adapted to control flow across the entire width of said tundish to impart a desired cross-sectional profile to said molten metal withdrawn from said tundish wherein each said plurality of means for controlling flow of a metal across said width portion of said tundish further comprises a plate and means for vertically adjusting each said plate to define a flow passageway between a bottom edge of said plate and floor of said tundish.

9. The apparatus of claim 8 wherein said means for vertically adjusting each said plate further comprises a support member extending across said tundish and an actuator means mountable on said support member, each said actuator means for raising or lowering a said plate.

10. The apparatus of claim 9 wherein each said actuator means is manually adjustable.

11. The apparatus of claim 9 wherein each said actuator means is pneumatically adjustable.

12. The apparatus of claim 9 wherein each said actuator means is electrically or hydraulically adjustable.

13. The apparatus of claim 8 further comprising means for sensing a casting parameter and for controlling each of said means for controlling flow of molten metal across a width portion of said tundish responsive to a sensed casting parameter.

14. The apparatus of claim 13 wherein said means for sensing a casting parameter further comprises means for sensing a parameter selected from the group consisting of cast strip thickness, cast strip profile, molten metal temperature, molten metal depth in said tundish and casting speed.

15. A method of producing a continuously cast metal strip having a predetermined cross-sectional profile comprising:

a) providing a tundish having molten metal therein;

b) providing a moving chill surface;

c) flowing said molten metal from said tundish onto said moving chill surface; and d) individually controlling flow of molten metal across a plurality of widthwise portions of said tundish by providing a vertically adjustable plate at a predetermined distance from a floor of said tundish for each said widthwise portion to produce a cast strip having a predetermined cross-sectional profile.

16. The method of claim 15 further comprising the step of sensing a casting parameter and controlling flow of molten metal across said plurality of widthwise portions of said tundish responsive to said sensed casting parameter.

17. The method of claim 16 wherein said casting parameters are selected from the group consisting of casting strip thickness, cast strip profile, molten metal temperature, molten metal depth in said tundish and casting speed.

* * * * *